United States Patent [19]

Canterberry

[11] Patent Number: 4,950,342

[45] Date of Patent: Aug. 21, 1990

[54] POLYCAPROLACTONE-DETERRED NITROCELLULOSE PROPELLANT COMPOSITIONS AND METHOD

[75] Inventor: J. B. Canterberry, Crawfordville, Fla.

[73] Assignee: Olin Corporation, Cheshire, Conn.

[21] Appl. No.: 402,323

[22] Filed: Sep. 5, 1989

[51] Int. Cl.[5] ..... C06B 45/28

[52] U.S. Cl. ..... 179/10; 149/11; 149/109.6; 102/290; 264/3.4

[58] Field of Search ..... 149/10, 11, 109.6; 264/3.4; 102/290

[56] References Cited

U.S. PATENT DOCUMENTS 4,350,542 9/1982 Kincaid et al. ..... 149/11

4,389,263 6/1983 Allen ..... 149/11

4,638,735 1/1987 Lelu et al. ..... 149/11

4,654,093 3/1987 Bolinder et al. ..... 149/11

*Primary Examiner*—Stephen J. Lechert, Jr.

*Attorney, Agent, or Firm*—Dale L. Carlson

[57] ABSTRACT

Method for producing novel deterred granular nitrocellulose propellant powder compositions having a stable burn rate gradient. The invention comprises coating nitrocellulose propellant granules with a minor amount by weight of a polycaprolactone polymer which is soluble in nitrocellulose under conditions which cause the polymer to be gradually dissolved into the granules to produce maximum burn deterrence at the surface of the granules which gradually decreases inwardly therefrom to produce a desired burn rate gradient in the granules.

11 Claims, No Drawings

POLYCAPROLACTONE-DETERRED NITROCELLULOSE PROPELLANT COMPOSITIONS AND METHOD

Propellant powder compositions containing nitrocellulose propellant base, alone or in combination with other propellant bases, represent the most common gun powders in use today. However, such compositions have a high burn rate and therefore require the presence of additives such as dibutyl phthalate, known as deterrents, which reduce the initial burn rate of the powder compositions and impart a burn rate gradient so as to produce high projectile velocities while preventing unduly high chamber pressures.

Among the disadvantages of liquid deterrents which plasticize the nitrocellulose, such as dibutyl phthalate, is their tendency to migrate more deeply into the composition during storage, until equilibrium is reached or approached and the necessary burn gradient is destroyed or degraded. Also dibutyl phthalate cannot be used with high levels of nitroglycerine, a desirable secondary base in nitrocellulose propellant compositions.

Solid, barrier type deterrents are also known. Some of these materials do not penetrate the propellant powder to any substantial extent and therefore fail to provide the gradual gradient in the burn rate necessary to accomplish the desired rate.

It has also been proposed to provide nitrocellulose powder burn rate deterrents in the form of linear alkyd polyester polymers which are compatible with the nitrocellulose, migrate thereinto during the coating operation but are said to be substantially non-migrating during storage at temperatures up to about 150° F. Reference is made to U.S. Pat. No. 3,743,554, the disclosure of which is incorporated herein by reference in its entirety, for its disclosure of such deterrents which are applied to an aqueous slurry of the gun powder to produce a burn rate gradient which is dependent upon the time, temperature and amount of deterrent present during the coating procedure. The present compositions represent a more economical alternative to the use of the prior art alkyd polymers, i.e., dibasic acid-dihydric alcohol condensates, as deterrents for nitrocellulose propellant powders.

In one aspect, the present invention relates to a nitrocellulose propellant powder composition having a desired burn rate gradient, said composition comprising granules which contain a major amount of nitrocellulose base and a minor amount by weight of a burn rate deterrent comprising a polycaprolactone polymer, said granules containing an outside surface coating of said polymer, and said granules containing at least a portion of said polymer inside said granules.

In another aspect, the present invention relates to a method for providing granular nitrocellulose propellant powder composition with a stable burn rate gradient whereby burning of granules of such compositions is deterred at the surface of said granules and is deterred to a gradually lesser degree inwardly from said surface, said method comprising coating said granules with a minor amount by weight of a polycaprolactone polymer which is soluble in the nitrocellulose component of said granules, in the presence of a volatile solvent for said polycaprolactone which is a solvent or non-solvent for said nitrocellulose, for a sufficient period of time and at an elevated temperature to cause a portion of said polycaprolactone to be gradually dissolved into said nitrocellulose, and impregnated into said granules, said polycaprolcatone being a burn rate deterrent for said granules.

The present invention is based upon the discovery that polycaprolactone polymers are excellent non-migrating burn rate deterrent materials for nitrocellulose propellant compositions, including those containing nitroglycerin, to provide propellant compositions, such as gun powders, which have excellent burn rate gradient properties which remain uniform and stable even after extended periods of storage.

The present burn-rate deterrent polymers are readily commercially available materials which are relatively easy to apply by conventional coating methods and are effective in relatively small amounts with a preferred use range of between about 3 percent and 10 percent by weight, more preferably between about 5 percent and about 8 percent by weight, based upon the weight of the propellant compositions, to overcome the important disadvantages of conventional migratory plasticizing-types of deterrents, and to provide and alternative to alkyd-type deterrents.

The present burn rate deterrents are polycaprolactone polymers which are polyesters formed by a ring-opening reaction of capolactones initiated preferably by polyhydric alcohols including dihydric alcohols such as ethylene glycol and trihydric alcohols such as glycerine. Polycaprolactone polymers of these types are commercially available from Union Carbide Corporation under the registered trademark "TONE ®" polymers.

The present nitrocellulose propellant powder compositions are conventional single base, (nitrocellulose), or multi-base granular compositions, such as described in greater detail in the aforementioned U.S. Pat. No. 3,743,554. Nitroglycerin may be an included base, even in high levels, since unlike some known deterrents such as dibutylphthalate, polycaprolactone polymers do not diffuse into nitroglycerin-containing propellants. The present propellant compositions can contain from about 40 percent to about 95 percent by weight of nitrocellulose, from about 0 percent to about 60 percent by weight of one or more additional propellant bases such as nitroglycerin, and up to about 5 percent by weight of other additives conventional in the art. The preferred nitroglycerin content is from about 5 percent to about 40 percent, most preferably about 10 percent to about 20 percent by weight.

The present invention provides a simple coating method for applying stable, non-migrating coatings of polycaprolactone polymers to nitrocellulose propellant composition powder granules in order to provide a burn-deterring or slowing outer layer to the powder particles which establishes an excellent burn rate gradient between the burn rate of the surface areas of the powder particles and the burn rate of the interior areas of the powder particles. The present coating method also enables the degree of penetration of the polycaprolactone polymer into the powder particles to be controlled so as to provide a concentration gradient within the powder particles whereby the concentration is greatest at the outer surface of the powder particles and is gradually smaller through the thickness of the powder particles toward the center thereof in order to produce a gradually weaker deterrent effect and a uniform burn rate gradient throughout the nitrocellulose propellant composition particles for maximum burning efficiency.

Important features of the present invention relate to the nature of polycaprolactone polymers. The polymers typically have a molecular weight of between about 350 and about 5,000, preferably between about 900 and about 3,000. Such polymers are compatible with and soluble in nitrocellulose and, when applied thereto by means of a volatile solvent which is a solvent or non-solvent for the nitrocellulose, they form a thin solid coating on the nitrocellulose, which is the major component of the propellant powder particles. Thus the deterrent has a strong affinity of the nitrocellulose and is dissolved thereinto a slight degree to form a solid mixed polymer interface therebetween. This prevents the deterrent polymer from migrating elsewhere within the powder composition, thus providing a stable composition at ambient temperature, and enhances the burn rate gradient.

Also the present deterrent polymers are available in a variety of molecular weights, such as 900, 2,000 and 3,000, each of which has a different inherent viscosity and a different degree of solubility in the nitrocellulose. The higher molecular weight materials are more viscous and produce thicker coatings on the nitrocellulose particles, which generally result in greater penetration within the nitrocellulose particles at extended coating times and more elevated temperatures. For example, a powder having a three thousandth of an inch ball size would have polymer typically impregnated 80 to 120 microns into the particle.

The polycaprolactones which are terminated with difunctional and trifunctional alcohol groups appear to have maximum co-solubility in the nitrocellulose and have been found to have the greatest impact upon the burn rate gradient of the propellant composition.

The present deterrent polymers may be coated onto the propellant powder compositions in the same manner as disclosed in aforementioned U.S. Pat. No. 3,743,554. Thus, an aqueous slurry of the propellant powder is formed and then a dilute solution of the caprolactone polymer, in a volatile solvent which is a solvent or non-solvent for nitrocellulose, is introduced to the aqueous slurry within a mixing vessel. The vessel is closed and then heated to a temperature between about 40° C. and about 95° C., preferably about 40° C. and about 85° C., more preferably between about 65° C. and about 85° C., typically for a period of between about 1 and 8 hours. The effective amounts of the polycaprolactone deterrent are between about 3 percent and 10 percent by weight based upon the weight of the propellant composition, and the deterrent is applied as a dilute solution containing from about 30 percent to 70 percent by weight of the deterrent in a suitable volatile solvent such as methylene chloride, benzene, diethyl ether, n-butanol or other solvent or non-solvent for the nitrocellulose.

The duration and temperature of the coating process and the amount of the applied deterrent polymer are variable within the given limits depending upon the exact composition of the nitrocellulose propellant composition and the end use to which it is applied.

The following example illustrates a suitable embodiment of the present invention.

EXAMPLE

A nitrocellulose propellant composition is formulated to contain about 70 percent by weight of nitrocellulose, 29 percent nitroglycerin and 1 percent of diphenylamine stabilizer . The composition is formed in conventional manner into a granular propellant powder having an average grain size of 0.65 inch length and 0.01 thickness.

The propellant powder is dispersed within a major volume of water, i.e., about 5 parts by weight of water per part by weight of the powder, to form an aqueous slurry.

A 50 percent by weight solution of polycaprolactone (TONE ® having a molecular weight of about 2,000) in ethylacetate is prepared and then added to the aqueous propellant powder composition in sufficient volume to introduce about 6 percent by weight of the deterrent polymer based upon the weight of the propellant powder in the slurry.

The container is covered and the mixture is heated to about 80° C. for about 2 hours under continuous agitation, after which the solids are removed from the slurry and air dried to produce the desired deterred, free-flowing nitrocellulose propellant powder containing the polycaprolactone polymer as an outer coating on the powder granules, which coating has been dissolved gradually into the nitrocellulose component of the granules during the coating operation and then set in place during drying to provide a gradually-decreasing, stable concentration thereof towards the center of the granules resulting in an excellent burn rate gradient.

As noted above, the desired burn rate gradient can be designed into the propellant powder to suit a variety of end uses by adjusting the amount of applied polycaprolactone polymer, between bout 3 percent and 10 percent by weight of the propellant powder composition, and by selecting polycaprolactone polymers having different molecular weights and inherent viscosities having different degrees of solubility in nitrocellulose. Also the concentration of the polycaprolactone within its solvent has an effect upon the amount of the polymer deposited upon the granules although the solvent itself has no effect upon the penetration into the granules. The amount of penetration can also be increased by extending the duration of the coating process, up to about 4 hours, since this increases the amount of polycaprolactone which is coated out of its solution, while the elevated coating temperature increases the ability of the nitrocellulose to dissolve the polycaprolactone thereinto in larger amounts and to a greater extent of penetration. When the coating process is terminated and the coated powder is dried, further penetration ceases as the nitrocellulose and polycaprolactone polymer form a stable solid solution having a concentration of polycaprolactone which is greatest at the surface areas of the granules and decreases gradually towards the center of the granules to provide a gradually-decreasing burn deterrent effect resulting in the desired burn rate gradient.

It will be apparent to those skilled in the nitrocellulose propellant powder art that the present invention applies to single base and multiple base nitrocellulose propellant compositions containing the additives conventionally included within such compositions in minor amounts such as stabilizers, plasticizers and/or other materials.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

I claim:

1. A nitrocellulose propellant powder composition having a desired burn rate gradient, said composition comprising granules which contain a major amount of nitrocellulose base and a minor amount by weight of a burn rate deterrent consisting essentially of a polycaprolactone polymer, said granules containing an outside surface coating of said polymer, and said granules containing at least a portion of said polymer inside said granules.

2. A nitrocellulose propellant powder composition according to claim 1 in which said granules also contain a substantial proportion of nitroglycerin base.

3. A nitrocellulose propellant powder composition in which said granules contain from about 3 percent to about 10 percent by weight of polycaprolactone polymer.

4. A nitrocellulose propellant powder composition according to claim 3 in which said granules contain from about 5 percent to about 8 percent by weight of said polycaprolactone polymer.

5. A nitrocellulose propellant powder composition according to claim 1 in which said polycaprolactone polymer comprises a polyester of caprolactone and a polyhydric alcohol, and has terminal alcohol groups.

6. A nitrocellulose propellant powder composition according to claim 5 in which said terminal alcohol groups are polyfunctional.

7. A nitrocellulose propellant powder composition according to claim 7 in which said granules also contain from about 10 percent to about 50 percent by weight of nitroglycerine.

8. A nitrocellulose propellant powder composition according to claim 7 in which said granules also contain from about 10 percent to about 40 percent by weight of nitroglycerine.

9. A method for providing granular nitrocellulose propellant powder composition with a stable burn rate gradient whereby burning of granules of such compositions is deterred at the surface of said granules and is deterred to a gradually lesser degree inwardly from said surface, said method comprising coating said granules with a minor amount by weight of a polycaprolactone polymer which is soluble in the nitrocellulose component of said granules, in the presence of a volatile solvent for said polycaprolactone which is a solvent or non-solvent for said nitrocellulose, for a sufficient period of time and at an elevated temperature to cause a portion of said polycaprolactone to be gradually dissolved into said nitrocellulose, and impregnated into said granules, said polycaprolcatone being a burn rate deterrent for said granules.

10. The method according to claim 9 in which said coating step is conducted at a temperature of between about 40° C. and 95° C. and for a period between about 1 and 8 hours.

11. The method according to claim 9 in which said granular nitrocellulose propellant powder is present in the form of an aqueous slurry.

* * * * *